US008334484B2

(12) United States Patent
Roh et al.

(10) Patent No.: US 8,334,484 B2
(45) Date of Patent: Dec. 18, 2012

(54) COOKING APPARATUS

(75) Inventors: Hee-Suk Roh, Seoul (KR); Byeong-Wook Park, Seoul (KR)

(73) Assignee: LG Electronics Inc., Seoul (KR)

( * ) Notice: Subject to any disclaimer, the term of this patent is extended or adjusted under 35 U.S.C. 154(b) by 713 days.

(21) Appl. No.: 12/519,046

(22) PCT Filed: Dec. 14, 2007

(86) PCT No.: PCT/KR2007/006560

§ 371 (c)(1),
(2), (4) Date: Sep. 22, 2009

(87) PCT Pub. No.: WO2008/072936

PCT Pub. Date: Jun. 19, 2008

(65) Prior Publication Data

US 2010/0018961 A1 Jan. 28, 2010

(30) Foreign Application Priority Data

Dec. 14, 2006 (KR) ..... 10-2006-0127524

(51) Int. Cl.
*H05B 3/68* (2006.01)
*H05B 1/02* (2006.01)

(52) U.S. Cl. ..... 219/447.1; 219/506; 219/518; 219/626

(58) Field of Classification Search ..... 219/447.1, 219/518, 626
See application file for complete search history.

(56) References Cited

U.S. PATENT DOCUMENTS

| | | | | |
|---|---|---|---|---|
| 5,136,277 | A * | 8/1992 | Civanelli et al. | 340/568.1 |
| 5,893,996 | A * | 4/1999 | Gross et al. | 219/447.1 |
| 5,977,523 | A * | 11/1999 | Scott | 219/447.1 |
| 6,184,501 | B1 * | 2/2001 | Zapf | 219/447.1 |
| 6,242,721 | B1 * | 6/2001 | Borrmann et al. | 219/518 |
| 2001/0052519 | A1 * | 12/2001 | Engelmann et al. | 219/518 |
| 2004/0144769 | A1 * | 7/2004 | Pastore | 219/447.1 |
| 2006/0091135 | A1 | 5/2006 | Kondo et al. | |
| 2007/0164017 | A1 * | 7/2007 | Gouardo et al. | 219/626 |
| 2008/0017046 | A1 | 1/2008 | Huber et al. | |

FOREIGN PATENT DOCUMENTS

| | | | |
|---|---|---|---|
| KR | 2003-0027248 | A | 4/2003 |
| KR | 10-2004-105533 | A | 12/2004 |
| KR | 10-2005-101327 | A | 10/2005 |
| KR | 10-2005-105428 | A | 11/2005 |
| WO | WO-2005/106335 | A2 | 11/2005 |

* cited by examiner

*Primary Examiner* — Angel Roman
(74) *Attorney, Agent, or Firm* — Birch, Stewart, Kolasch & Birch, LLP

(57) ABSTRACT

Provided are a cooking apparatus and a method for controlling the same. The cooking apparatus senses the size of a cooking vessel, or more specifically, the undersurface area of the cooking vessel, and selectively operates heaters accordingly. Therefore, food can be more efficiently cooked.

19 Claims, 5 Drawing Sheets

[Fig. 6]
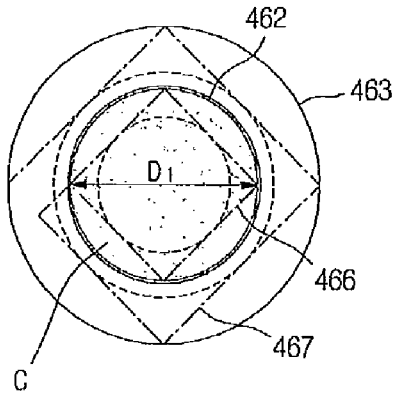
[Fig. 7]
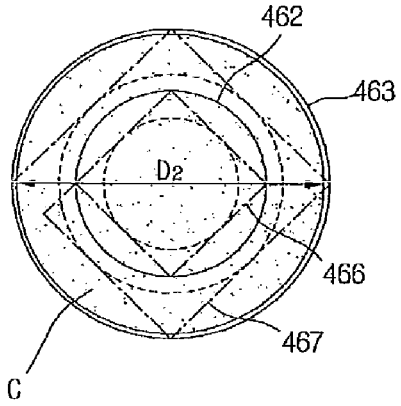
[Fig. 8]
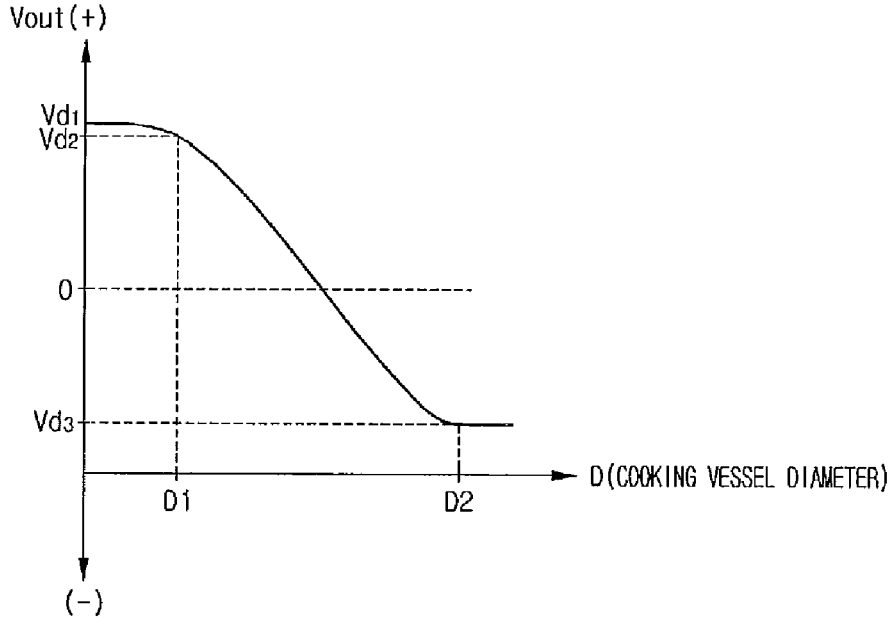

COOKING APPARATUS

TECHNICAL FIELD

The present disclosure relates to a cooking apparatus, and more particularly, to a cooking apparatus that includes a cooktop for cooking food contained in a vessel placed thereon, and to a method of controlling the cooking apparatus.

BACKGROUND ART

In general, a cooking apparatus is an appliance that uses heat from a heater or microwaves to cook food. A cooking apparatus that uses a heater includes a cooktop, atop which a cooking vessel containing food to be cooked is placed. A cooktop includes an inner heater, and an outer heater provided at the outside of the inner heater. The inner and outer heaters are selectively operated to heat a cooking vessel according to the size of the cooking vessel (or more specifically, the undersurface area of the cooking vessel) placed on top of the cooktop.

DISCLOSURE OF INVENTION

Technical Problem

In cooking apparatuses according to the related art that include such cooktops, a user determines whether to operate the inner heater and the outer heater. That is, the user determines whether to operate only the inner heater or both the inner and outer heaters, based on the size of the cooking vessel. Thus, a user may mistakenly operate both of the inner and outer heaters or only the inner heater, despite a cooking vessel being unsuitably small or large for the operation selected by the user, leading to overheating or underheating of the cooking vessel.

Technical Solution

In one embodiment, a cooking apparatus including: a top plate including a first cooking region and a second cooking region on which a cooking vessel is seated; a first heating portion configured to heat a portion of the cooking vessel seated on the first cooking region; a second heating portion configured to heat a portion of the cooking vessel seated on the second cooking region; a first sensing portion configured to sense whether the cooking vessel is seated on the first cooking region; a second sensing portion configured to sense whether the cooking vessel is seated on the second cooking region; and a controlling portion configured to control operations of the first heating portion and the second heating portion, according to whether the first sensing portion and the second sensing portion sense that the cooking vessel is seated on the first cooking region alone or that the cooking vessel is seated on the first cooking region and at least a portion of the second cooking region.

In another embodiment, a method for controlling a cooking apparatus, the method including: outputting respective signals from a first sensing portion and a second sensing portion, according to whether or not areas of a cooking vessel are seated on a first cooking region or are seated on the first cooking region and at least portion of a second cooking region; determining with a controlling portion whether the cooking vessel is seated on the first cooking region and the second cooking region, through receiving the signals respectively output from the first sensing portion and the second sensing portion; and selectively performing with the controlling portion on/off operations of a first heat source and a second heat source that respectively heat a portion of the cooking vessel seated on the first cooking region and the second cooking region, according to a result of the step of determining.

Advantageous Effects

The cooking apparatus according to the present disclosure is able to cook food by efficiently operating heat sources according to the size of a cooking vessel containing the food.

BRIEF DESCRIPTION OF THE DRAWINGS

FIGS. 5 to 7 are plan views showing operating states of a cooking apparatus according to embodiments of the present disclosure.

FIG. 8 is a graph representing voltage output from a synthesizer, dependant on the size of a seated cooking vessel according to embodiments of the present disclosure.

BEST MODE FOR CARRYING OUT THE INVENTION

The details of one or more embodiments are set forth in the accompanying drawings and the description below. Other features will be apparent from the description and drawings, and from the claims.

Reference will now be made in detail to the embodiments of the present disclosure, examples of which are illustrated in the accompanying drawings.

Figure 1:
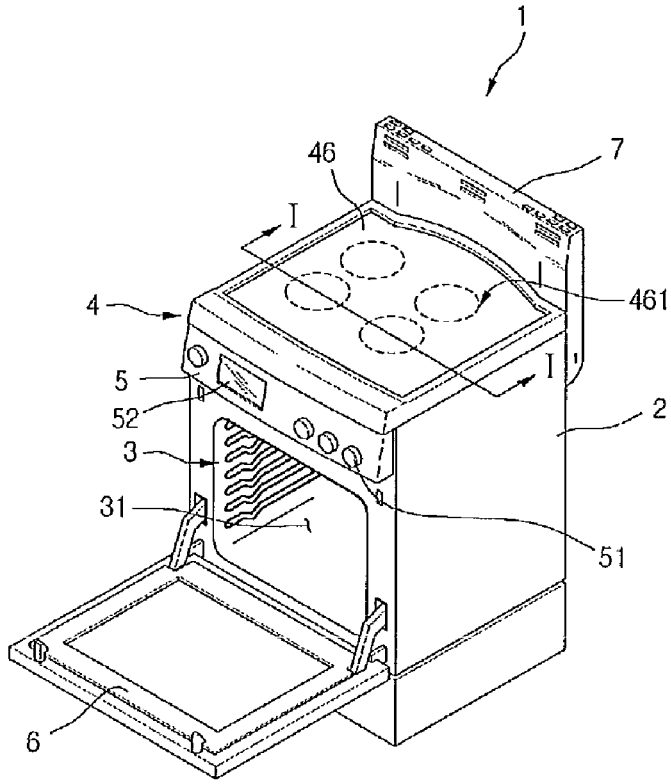
FIG. 1 is a perspective view of a cooking apparatus according to embodiments of the present disclosure.
Figure 2:
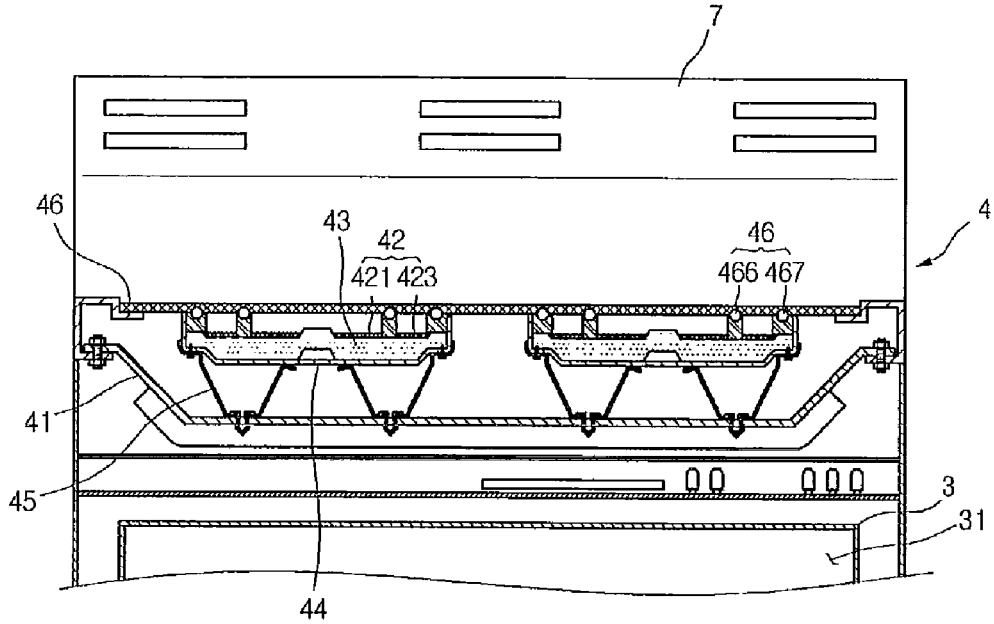
FIG. 2 is a sectional view of FIG. 1 taken along line I-I'.
Figure 3:
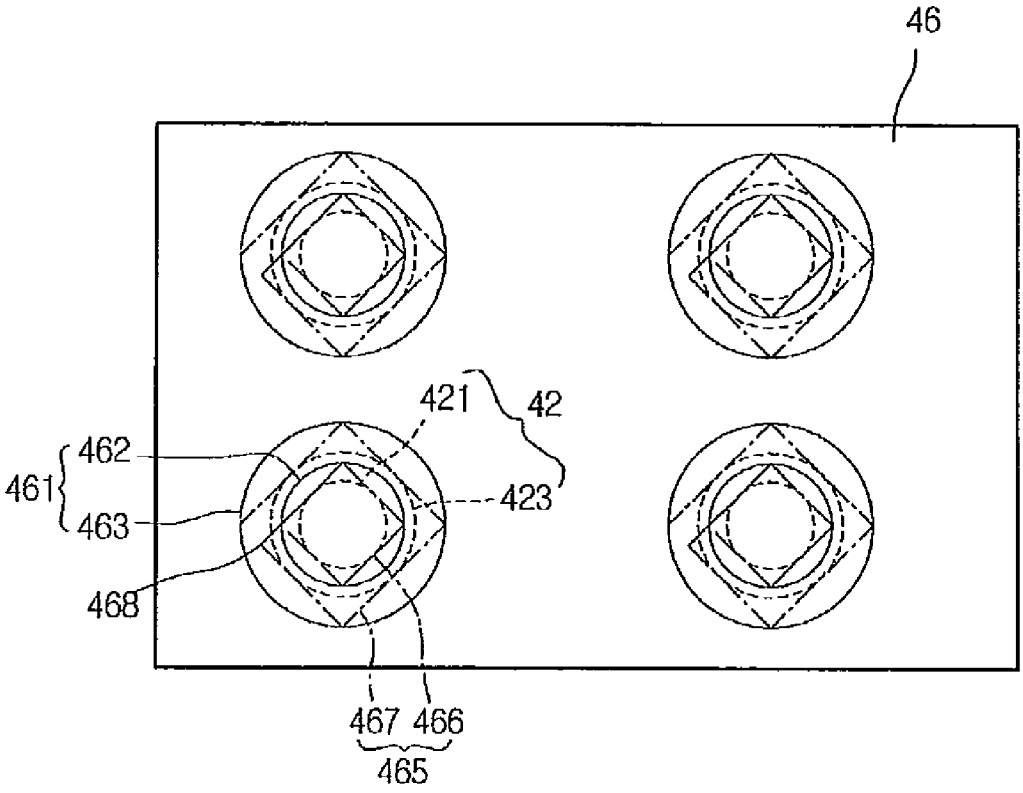
FIG. 3 is a plan view according to embodiments of the present disclosure.
Figure 4:
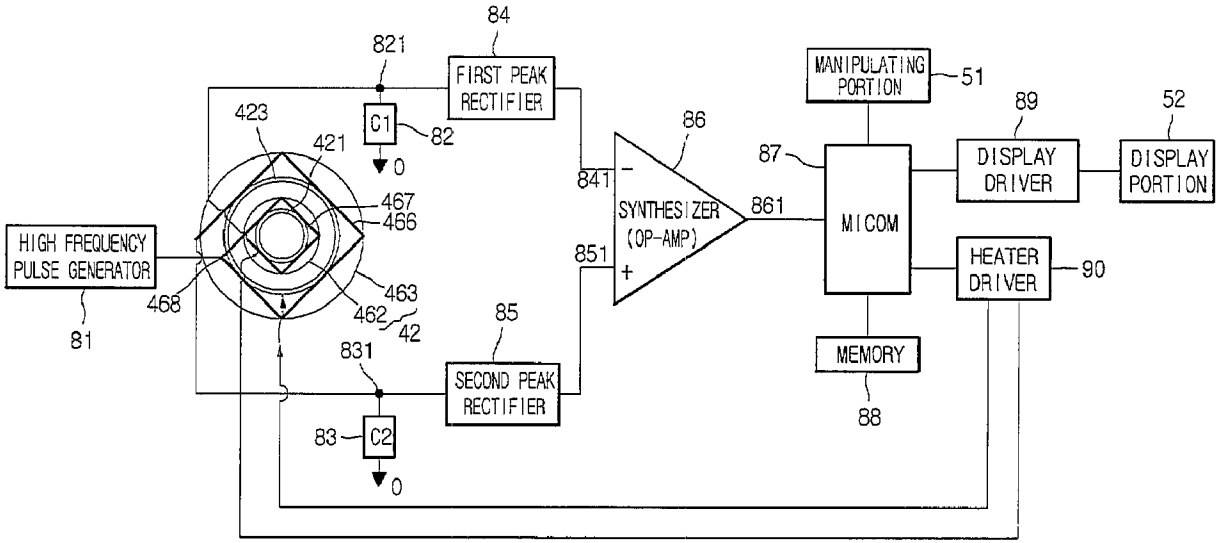
FIG. 4 is a block diagram according to embodiments of the present disclosure.

FIG. 1 is a perspective view of a cooking apparatus according to embodiments of the present disclosure, FIG. 2 is a sectional view of FIG. 1 taken along line I-I', FIG. 3 is a plan view according to embodiments of the present disclosure, and FIG. 4 is a block diagram according to embodiments of the present disclosure.

Referring to FIGS. 1 to 4, a cooking apparatus 1 according to the present disclosure includes a main body 2, an oven 3, a cooktop 4, a control panel 5, and a back guide 7. Cooking of food occurs in the oven 3 and on the cooktop 4. The control panel 5 is used to control the operation of the cooking apparatus 1. The back guide 7 guides exhaust gases generated during cooking of food in the oven 3.

In further detail, the oven 3 is provided in the central portion of the main body 2. A cooking compartment 31 in which food is actually cooked is provided inside the oven 3. Also, a door 6 is provided on the oven 3. The door 6 is used to selectively open and close the cooking compartment 31. While not shown, a heat source, such as a heater for cooking food, is provided within the cooking compartment 31.

The cooktop 4 is provided at the top surface of the main body 2 above the oven 3. Referring to FIG. 2, the cooktop 4 includes a cabinet 41, a heater 42, an insulator 43, an insulator housing 44, a housing support portion 45, and a top plate 46.

The cabinet 41 provides a space in which the heater 42, insulator 43, insulator housing 44, and housing support portion 45 are installed. The cabinet 41 is fixed to the main body 2.

The heater 42 supplies heat for cooking food on the cooktop 4. The heater 42 includes an inner heater 421 and an outer heater 423. The inner heater 421 has a round shape with a predetermined diameter. The outer heater 423 is annular in shape and disposed such that its inner circumference is separated by a predetermined gap around the outer circumference of the inner heater 421. The inner heater 421 and the outer heater 423, as described below, are selectively operated according to the size of a cooking vessel containing food.

The insulator 43 thermally insulates the heater 42. The inner heater 421 and the outer heater 423 are provided on the upper surface of the insulator 43. The insulator 43 is provided within the insulator housing 44.

The housing support portion 45 supports the insulator housing 44. For this, one end of the housing support portion 45 is fixed to the floor surface of the cabinet 41, and the other end of the housing support portion 45 is fixed to the undersurface of the insulator housing 44.

The top plate 46 simultaneously seals the space of the cabinet in which the heater 42 and other components are installed, and defines the top surface exterior of the cooktop 4. The top plate 46 is formed of ceramic or other material capable of conducting heat from the heater 42 and having a predetermined strength.

Referring to FIG. 3, a plurality of cooking vessel seating portions 461 is provided on the top plate 46. The cooking vessel seating portions 461 are portions on which cooking vessels containing food are placed. The cooking vessel seating portions 461 include a first cooking region 462 and a second cooking region 463. The first cooking region 462 is a region heated by the inner heater 421, and the second cooking region 463 is a region heated by the outer heater 423.

The first cooking region 462 and the second cooking region 463 have a coil 465 imbedded therein. The coil 465 includes an inner coil 466, an outer coil 467, and a contact portion 468. The inner coil 466 and the outer coil 467 are respectively embedded in the first and second cooking regions 462 and 463. More specifically, the inner coil 466 is rectangular in shape, to which the inner heater 421 is internally tangent. The outer coil 467 is also rectangular in shape, to which the outer heater 423 is internally tangent. The shapes of the inner coil 466 and the outer coil 467 are not limited hereto, and may have various sizes and shapes to which the inner heater 421 and outer heater 423 may be internally tangent. The contact portion 468 is a portion connecting the inner coil 466 and the outer coil 467. In actuality, the inner coil 466 and the outer coil 467 may be formed of a single line, and the contact point 468 may formed at a connecting portion of the inner coil 466 and the outer coil 467.

The inner coil 466 and outer coil 467 perform variable inductance that is varied according to the undersurface area of a metal cooking vessel seated on the first and second cooking regions 462 and 463 corresponding respectively to the inner and outer coils 466 and 467. In more detail, the inductance of the inner coil 466 and the outer coil 467 is reduced as the undersurface area of a cooking vessel seated on the first and second cooking regions 462 and 463 increases. A high frequency pulse output from a high frequency pulse generator 81 (in FIG. 4) is input to the contact portion 468.

The control panel 5 is provided on a front upper end portion of the main body 2 above the oven 3 and below the cooktop 4. The control panel 5 includes a manipulating portion 51 that receives control signals for operating the cooking apparatus 1, a display portion 52 displaying various data on the operation of the cooking apparatus 1, and various other components for controlling the cooking apparatus 1.

Various components for sensing the undersurface area of a cooking vessel seated on the top surface of the cooktop 4 (or the cooking vessel seating portion 461) are provided in the control panel 5. Referring to FIG. 4, a high frequency pulse generator 81, a first and second capacitor 82 and 83, a first and second peak rectifier 84 and 85, a synthesizer 86, a micro processor or processor (micom) 87, a memory 88, a display driver 89, and a heater 90 are disposed in the control panel 5.

The high frequency pulse generator 81 provides a high frequency pulse signal to the inner coil 466 and outer coil 467. For this end, the high frequency pulse generator 81 is connected to the contact portion 468.

The first and second capacitors 82 and 83 form a first and second sensing portion, together respectively with the inner coil 466 and the outer coil 467. The first and second sensing portions sense whether a cooking vessel is seated on the first and second cooking region 462 and 463, respectively. That is, the first and the second sensing portion respectively distributes a voltage of a high frequency pulse signal output from the high frequency pulse generator 81 according to undersurface regions of a cooking vessel that are seated respectively on the first and second cooking regions 462 and 463, which respectively correspond to the inner coil 466 and the outer coil 467. Also, the voltages of the high frequency pulse signal distributed by the first and second sensing portions are output through a first output node 821 and a second output node 831. As described above, however, the inductances of the inner coil 466 and the outer coil 467 are decreased as the undersurface areas of the cooking vessel seated on the first and second cooking regions 462 and 463 increase. Therefore, the voltage of the high frequency pulse signal output from the first and second output nodes 821 and 831 is increased according to the undersurface areas of the cooking vessel seated on the first and second cooking regions 462 and 463 corresponding to the inner coil 466 and the outer coil 467, respectively. The capacitances of the first and second capacitors 82 and 83 are set so that a predetermined difference between the maximum voltages of the high frequency pulse signals output from the first and second output nodes 821 and 831 is realized, based on there being an absence of a cooking vessel seated on the first and second cooking regions 462 and 463 corresponding to the inner coil 466 and the outer coil 467.

The first and second peak rectifiers 84 and 85 rectify the high frequency pulse signals output from the first and second output nodes 821 and 831 to direct current signals. The first and second peak rectifiers 84 and 85 also input the rectified direct current signals to first and second input nodes 841 and 851 of the synthesizer 86, respectively. Here, the voltage of the direct current signal input to the first input node 841, as a maximum voltage of the high frequency pulse signal output from the first sensing portion, becomes a reference voltage of the synthesizer 86. The voltage of the direct current signal input to the second input node 851, as a maximum voltage of the high frequency signal output from the second sensing portion, becomes a comparison voltage that is compared to the reference voltage of the synthesizer 86.

The synthesizer 86 combines the signals output from the first and second sensing portions, and outputs the combined signals to the micom 87. In other words, the synthesizer 86 subtracts the voltage of the direct current signal input from the first peak rectifier 84 from the voltage of the direct current signal input from the second peak rectifier 85, and amplifies and outputs the difference to the micom 87 through an output node 861.

The micom 87 performs a comparison between the voltage of the signal input from the synthesizer 86 (hereinafter referred to as a "comparison voltage VS") and data stored in the memory 88, and outputs a control signal corresponding to the compared value to the display driver 89 and the heater driver 90. Data such as first through third reference voltages Vd1, Vd2, and Vd3 (described below) are stored in the memory 88.

The display driver 89 responds to the control signal input from the micom 87 to operate the display portion 5. The display portion 5 displays information on the operation of the cooking apparatus 1 such as "standby for cooking" on the display portion 5, according to the operation of the display portion 52.

The heater driver 90 responds to the control signal input from the micom 87, and operates the inner heater 421 and the outer heater 423. The inner heater 421 is turned on or off according to the operation of the heater driver 90, and all or a portion of the outer heater 423 is turned on or off. Here, an 'ON' operation of a portion of the outer heater 423 signifies that a portion of the outer heater 423 is operated or the outer heater 423 is operated at a low output.

Next, the function of the cooking apparatus according to the present disclosure will be described in detail with reference attached diagrams.

Figure 5:
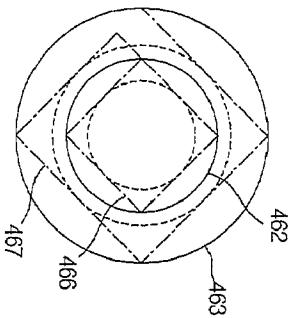

FIGS. 5 to 7 are plan views showing operating states of a cooking apparatus according to embodiments of the present disclosure, and FIG. 8 is a graph representing voltage output from a synthesizer, dependant on the size of a seated cooking vessel according to embodiments of the present disclosure.

Referring to FIGS. 5 to 8, first, when the cooking apparatus is not being used to cook food, cooking vessels are not seated on the first and second cooking regions 462 and 463 corresponding to the inner coils 466 and the outer coils 467. Thus, the voltage of a signal output from the output node 861 of the synthesizer 86 can be called a first reference voltage Vd1.

Next, referring to FIGS. 6 to 8, when the diameter D1 of a cooking vessel C is less than the diameter of the first cooking region 462, the cooking vessel C is seated on the entirety or a portion of the first cooking region 462 corresponding to the inner coil 466. Here, voltage of a signal output from the output node 861 of the synthesizer 86 can be called a second reference voltage Vd2. The second reference voltage Vd2 is a value that is less than the first reference voltage Vd1, and signifies a value that corresponds to the diameter D1 of the cooking vessel C.

Next, with reference to FIGS. 7 and 8, if the diameter D2 of the cooking vessel C is greater than the diameter of the first cooking region 462 and less than the diameter of the second cooking region 463, the cooking vessel is seated on the entirety of the first cooking region 462 and the entirety or a portion of the second cooking region 463. Here, a voltage of a signal output from the output node 861 of the synthesizer 86 can be called a third reference voltage Vd3. The third reference voltage Vd3 is a value less than the second reference voltage Vd2, and signifies a value corresponding to the diameter D2 of the cooking vessel C.

Then, the first to third reference voltages Vd1, Vd2, and Vd3 are stored in the memory 88. The first to third reference voltages Vd1, Vd2, and Vd3 are reference voltages that are compared to a comparison voltage Vs. Specifically, when the comparison voltage Vs lies in a range exceeding the first reference voltage Vd1, this signifies that a cooking vessel is not seated on a first and second cooking region 462 and 463. When the comparison voltage Vs lies in a range less than the first reference voltage Vd1 and equal to or greater than the second reference voltage Vd2, this signifies that a cooking vessel is seated on all or a portion of the first cooking region 462. When the comparison voltage Vs lies in a range less than the second reference voltage Vd2 and equal to or greater than the third reference voltage Vd3, this signifies that a cooking vessel is seated on all of the first cooking region 462 and only a portion of the second cooking region 463. When the comparison voltage Vs lies in a range less than the third reference voltage Vd3, this signifies that a cooking vessel is seated on the entirety of the first and second cooking regions 462 and 463.

With reference to FIG. 8, it is worth noting that there is an increase in the rate of change of voltage output from the first and second sensing portions, according to an increase in size of the diameters D1 and D2 of a cooking vessel. Thus, a conversion point is provided in a region between the first and second diameters D1 and D2, at which voltage is converted from a positive to negative state.

Below, a detailed description of a method for controlling a cooking apparatus according to embodiments of the present disclosure will be provided with reference to diagrams.

Figure 9:
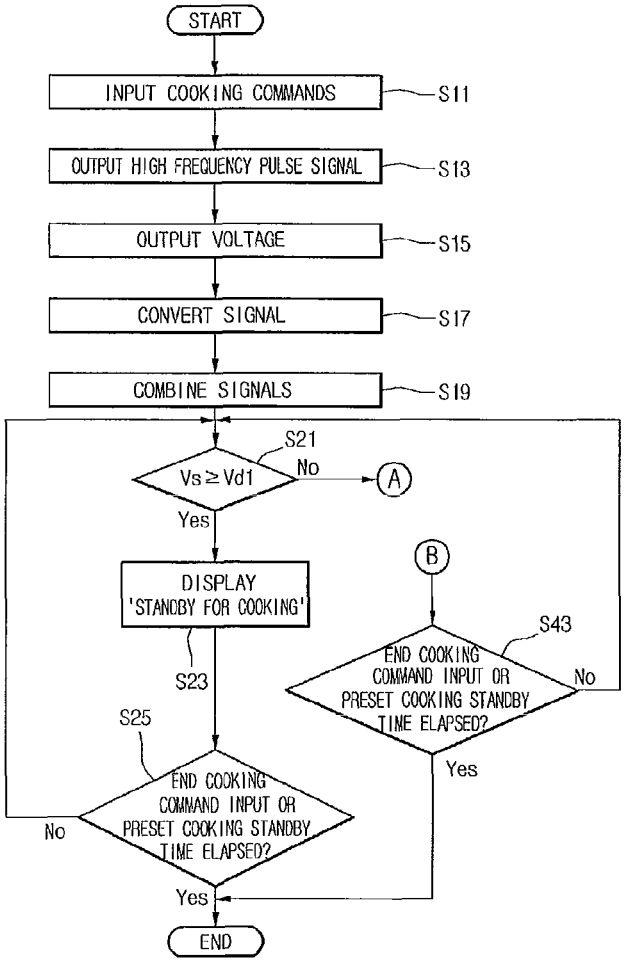
FIGS. 9 and 10 are flowcharts of a method for controlling a cooking apparatus according to embodiments of the present disclosure.
Figure 10:
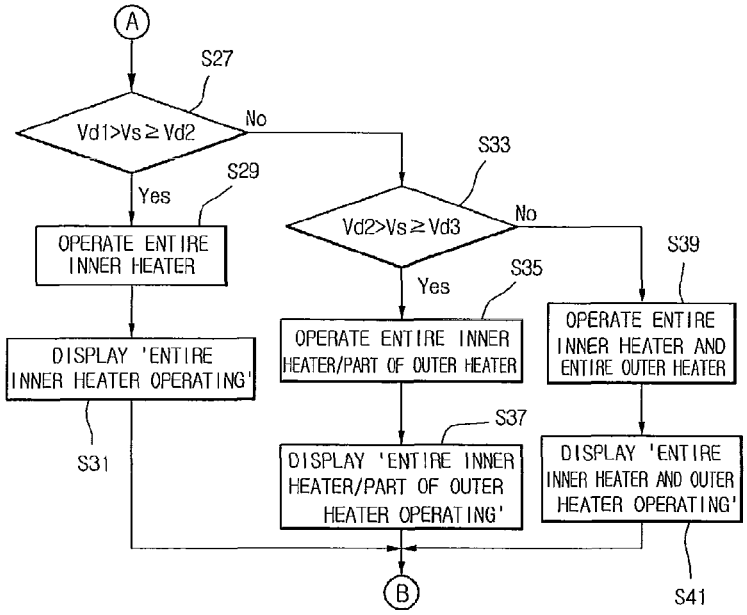

FIGS. 9 and 10 are flowcharts of a method for controlling a cooking apparatus according to embodiments of the present disclosure.

Referring to FIGS. 9 and 10, first, a user's cooking commands are input through the manipulating portion 51 (in FIG. 1) in operation S11. When the manipulating portion 51 receives cooking commands in operation S11, the high frequency pulse signal generator 81 (in FIG. 4) outputs a high frequency pulse in operation S13.

The voltage of the high frequency pulse output from the high frequency pulse generator 81 is distributed and output through the first and second sensing portions in operation S15. The high frequency pulse voltages output in operation S15 are rectified to direct current signals and output to the synthesizer 86 (in FIG. 4) by the first and second peak rectifiers 84 and 85 (in FIG. 4) in operation 17. The synthesizer 86 combines the direct current signals input from the first and second peak rectifiers 84 and 85, and outputs the combined direct current signals to the micom 87 (in FIG. 4) in operation S19.

The micom 87 compares a comparison voltage Vs input from the synthesizer 86 to a first reference voltage Vd1, and determines whether the comparison voltage Vs is greater than the first reference voltage Vd1 in operation S21. If the comparison voltage Vs is determined to be greater than the first reference voltage Vd1 in operation S21, a cooking vessel is not seated on either of the first and second cooking regions 462 and 463 (in FIG. 3). Therefore, the micom 87 does not operate the inner and outer heaters 421 and 423 (in FIG. 2), and the display portion 52 (in FIG. 1) is controlled to display a message to the effect of 'standby for cooking' in operation S23.

Next, while the message 'standby for cooking' is displayed by the display portion 52, the micom 87 determines in operation S25 whether an end cooking command is input through the manipulating portion 51 or a preset standby time has elapsed. If the micom 87 determines in operation S25 that the end cooking command is input or the preset standby time has elapsed, the display portion 52 ends its displaying, and the controlling of cooking is ended.

If in operation S21, the comparison voltage Vs is determined not to be equal to or greater than the first reference voltage Vd1, the micom 87 determines that the comparison voltage Vs lies in a range less than the first reference voltage Vd1 and equal to or greater than a second reference voltage Vd2 in operation S27. When the micom 87 determines that the comparison voltage Vs lies in a range less than the first reference voltage Vd1 and equal to or greater than the second reference voltage Vd2, it operates the entire inner heater 421 in operation S29. Also, the micom 87 controls the display portion 52 to display a message to the effect of 'entire inner heater operating' in operation S31.

If it is determined in operation S27 that the comparison voltage Vs does not lie in a range less than the first reference voltage Vd1 and equal to or greater than the second reference voltage Vd2, the micom 87 determines in operation S33 whether the comparison voltage Vs lies in a range less than the second reference voltage Vd2 and equal to or greater than a third reference voltage Vd3. If the micom 87 determines in operation S33 that the comparison voltage Vs lies in a range less than the second reference voltage Vd2 and equal to or greater than the third reference voltage Vd3, it operates the entire inner heater 421 and a portion of the outer heater 423 in operation S35. The micom 87 also controls the display portion 52 to display a message to the effect of 'entire inner heater/portion of outer heater operating' in operation S37.

When the micom 87 determines in operation S33 that the comparison voltage Vs does not lie in a range less than the second reference voltage Vd2 and equal to or greater than the third reference voltage Vd3—that is, if it is determined that the comparison voltage Vs is less than the third reference voltage Vd3, the micom 87 operates the entire inner heater 421 and the entire outer heater 423 in operation S39. The micom 87 also controls the display portion 52 to display a message to the effect of 'inner/outer heaters entirely operating' in operation S41.

In operation S43, where the inner heater 421 or/and the outer heater 423 are operated in their entirety or partially and the display portion 52 displays a cooking mode in operations S31, S37, and S39, it is determined whether the manipulating portion 51 receives an input of a cooking command or a preset cooking time has elapsed. When the micom 87 determines that a cooking command is input through the manipulating portion 51 or a preset cooking time has elapsed, the micom 87 ends the operation of the inner heater 421 or/and the outer heater 423 and the displaying by the display portion 52, and ends the controlling of the cooking apparatus.

As described above, a cooking apparatus and a method of controlling the same according to the present disclosure selectively operates heaters according to the undersurface area of a cooking container seated on a cooktop. Therefore, the present disclosure can prevent overheating or underheating during the process of cooking foods, and thus prevent energy waste and inefficient cooking.

Any reference in this specification to "one embodiment," "an embodiment," "exemplary embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with others of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

INDUSTRIAL APPLICABILITY

As described above, a cooking apparatus and a method of controlling the same according to the present disclosure selectively operates heaters according to the undersurface area of a cooking container seated on a cooktop. Therefore, the present disclosure can prevent overheating or underheating during the process of cooking foods, and thus prevent energy waste and inefficient cooking, for a high industrial applicability.

The invention claimed is:

1. A cooking apparatus, comprising:

a top plate including a first cooking region and a second cooking region on which a cooking vessel is seated;

a first heating portion configured to heat a portion of the cooking vessel seated on the first cooking region;

a second heating portion configured to heat a portion of the cooking vessel seated on the second cooking region;

a first sensing portion configured to sense whether the cooking vessel is seated on the first cooking region;

a second sensing portion configured to sense whether the cooking vessel is seated on the second cooking region;

a generator outputting high frequency signals provided to the first sensing portion and the second sensing portion; and a controlling portion configured to control operations of the first heating portion and the second heating portion, according to whether the first sensing portion and the second sensing portion sense that the cooking vessel is seated on the first cooking region alone or that the cooking vessel is seated on the first cooking region and at least a portion of the second cooking region.

2. The cooking apparatus according to claim 1, wherein one of the first cooking region and the second cooking region is disposed at an outside of the other of the first cooking region and the second cooking region, and the first heating portion is an inner heater corresponding to the first cooking region, and the second heating portion is an outer heater disposed outside the inner heater and corresponding to the second cooking region.

3. The cooking apparatus according to claim 1, wherein the first sensing portion and the second sensing portion respectively include a coil formed with a single bent line.

4. The cooking apparatus according to claim 3, wherein the coils of the first and second sensing portions have respective inductances that are configured to vary in response to an area of the cooking vessel seated on the first cooking region and/or the second cooking region.

5. The cooking apparatus according to claim 1, wherein the first sensing portion and the second sensing portion respectively are configured to output a signal with a voltage, the respective voltages being variable in response to an area of the cooking vessel seated on the first cooking region and/or the second cooking region.

6. The cooking apparatus according to claim 5, wherein the first sensing portion and the second sensing portion respectively are configured to output a signal with a voltage, the respective voltages being inversely proportional according to an area of the cooking vessel seated on the first cooking region and/or the second cooking region.

7. The cooking apparatus according to claim 6, further comprising:

a synthesizer configured to combine the signals output from the first sensing portion and the second sensing portion, and to output the combined signals to the controlling portion.

8. The cooking apparatus according to claim 7, wherein the synthesizer is configured to output to controlling portion a signal with an amplified voltage difference of the signals output from the first sensing portion and the second sensing portion.

9. A method for controlling a cooking apparatus, the method comprising:

outputting respective signals from a first sensing portion and a second sensing portion, according to whether or not areas of a cooking vessel are seated on a first cooking region or are seated on the first cooking region and at least portion of a second cooking region;

determining with a controlling portion whether the cooking vessel is seated on the first cooking region and the second cooking region, through receiving the signals respectively output from the first sensing portion and the second sensing portion; and selectively performing with the controlling portion on/off operations of a first heat source and a second heat source that respectively heat a portion of the cooking vessel seated on the first cooking region and the second cooking region, according to a result of the step of determining, wherein the outputting of the respective signals comprises:

receiving an input of a high frequency pulse signal output from a generator respectively through the first sensing portion and the second sensing portion.

10. The method according to claim 9, wherein the step of outputting comprises:

distributing the high frequency pulse signal from the first sensing portion and the second sensing portion to the first cooking region and the second cooking region, according to an area on which the cooking vessel is seated, and outputting the distributed high frequency pulse signal to a synthesizer; and combining the signals output from the first sensing portion and the second sensing portion with the synthesizer, and outputting the combined signals to the controlling portion.

11. The method according to claim 10, wherein the step of outputting of the respective signals comprises:

outputting from the first sensing portion and the second sensing portion respective signals to the controlling portion, the signals being variable according to the area of the cooking vessel seated on the first cooking region and the second cooking region.

12. The method according to claim 10, wherein the first sensing portion and the second sensing portion respectively include a coil bent of a single line, the coils having inductances that are inversely proportional according to the area of the cooking vessel seated on the first cooking region and the second cooking region.

13. The method according to claim 10, wherein the step of determining comprises: controlling with the controlling portion operations of the first heat source and the second heat source, by comparing a comparison voltage of the signals output from the first sensing portion and the second sensing portion to pre-stored reference voltages.

14. The method according to claim 13, wherein the reference voltages comprise at least a first reference voltage equal to a maximum voltage of the signals output from the first sensing portion and the second sensing portion, and in the step of selective performing the on/off operations comprises:

performing off operations of the first heat source and the second heat source, when the comparison voltage of the signals output from the first sensing portion and the second sensing portion is equal to or greater than the first reference voltage.

15. The method according to claim 13, wherein the reference voltages comprise:

a first reference voltage equal to at least a maximum voltage of the signals output from the first sensing portion and the second sensing portion; and a second reference voltage equal to the comparison voltage of the signals output from the first sensing portion and the second sensing portion, when the cooking vessel is seated on only an entirety of the first cooking region; and wherein the step of the selective performing the on/off operations comprises:

performing off operations of the first heat source and the second heat source, when the comparison voltage of the signals output from the first sensing portion and the second sensing portion is equal to or greater than the first reference voltage, and performing an on operation of only the first heat source, when the comparison voltage of the signals output from the first sensing portion and the second sensing portion lies in a range less than the first reference voltage and equal to or greater than the second reference voltage.

16. The method according to claim 13, wherein the reference voltages comprise:

a first reference voltage equal to at least a maximum voltage of the signals output from the first sensing portion and the second sensing portion, a second reference voltage equal to a voltage of the signals output from the first sensing portion and the second sensing portion, when the cooking vessel is seated only on an entirety of the first cooking region, and a third reference voltage equal to a voltage of the signals output from the first sensing portion and the second sensing portion, when the cooking vessel is seated on the entirety of the first cooking region and an entirety of the second cooking region; and wherein the step of selective performing the on/off operations comprises:

performing off operations of the first heat source and the second heat source, when the comparison voltage of the signals output from the first sensing portion and the second sensing portion is equal to or greater than the first reference voltage, performing an on operation of only the first heat source, when the comparison voltage of the signals output from the first sensing portion and the second sensing portion lies in a range less than the first reference voltage and equal to or greater than the second reference voltage, performing an on operation of an entirety of the first heat source and a portion of the second heat source, when the comparison voltage of the signals output from the first sensing portion and the second sensing portion is less than the second reference voltage and equal to or greater than the third reference voltage, and performing an on operation of the entirety of the first heat source and an entirety of the second heat source, when the comparison voltage of the signals output from the first sensing portion and the second sensing portion is equal to or greater than the third reference voltage.

17. The method according to claim 9, wherein the step of outputting the respective signals comprises:

distributing by the first sensing portion and the second sensing portion respective high frequency pulses output from a high frequency pulse generator according to inductances of the coils inversely proportional to areas of the cooking vessel seated on the first cooking region and the second cooking region; and relaying the distributed high frequency pulse to the controlling portion.

18. The method according to claim 9, further comprising:

controlling through the controlling portion a display portion to display information on operations of the first heat source and the second heat source.

19. The method according to claim 18, wherein, with the exception of a case when it is determined in the step of determining that the cooking vessel is seated on the first cooking region and the second cooking region, performing by the controller off operations of the first heat source and the second heat source in the selectively performing of the on/off operations, displaying by the display portion a standby for cooking message, when the comparison voltage is equal to or greater than the reference voltages in the controlling of the display portion, and while the display portion displays the standby for cooking message, with the exception of a case in which the comparison voltage falls below the reference voltages, continuously displaying by the display portion the standby for cooking message until an end cooking command is input or a preset time elapses.

* * * * *